US009402516B2

(12) United States Patent
Pilch

(10) Patent No.: US 9,402,516 B2
(45) Date of Patent: Aug. 2, 2016

(54) VACUUM CLEANER INCLUDING A REMOVABLE DIRT COLLECTION ASSEMBLY

(71) Applicant: Techtronic Industries Co. Ltd., Tsuen Wan, New Territories (HK)

(72) Inventor: Alan Pilch, Hudson, OH (US)

(73) Assignee: Techtronic Industries Co. Ltd., Tsuen Wan, New Territories (HK)

( * ) Notice: Subject to any disclaimer, the term of this patent is extended or adjusted under 35 U.S.C. 154(b) by 75 days.

(21) Appl. No.: 14/550,375

(22) Filed: Nov. 21, 2014

(65) Prior Publication Data

US 2015/0143659 A1 May 28, 2015

Related U.S. Application Data

(60) Provisional application No. 61/907,881, filed on Nov. 22, 2013.

(51) Int. Cl.

| | |
|---|---|
| ***A47L 9/28*** | (2006.01) |
| ***A47L 5/28*** | (2006.01) |
| ***A47L 9/16*** | (2006.01) |
| ***A47L 9/14*** | (2006.01) |
| ***A47L 9/32*** | (2006.01) |

(52) U.S. Cl.

CPC ..... *A47L 5/28* (2013.01); *A47L 9/1409* (2013.01); *A47L 9/1463* (2013.01); *A47L 9/1691* (2013.01); *A47L 9/2842* (2013.01); *A47L 9/2878* (2013.01); *A47L 9/2884* (2013.01); *A47L 9/2889* (2013.01); *A47L 9/325* (2013.01)

(58) Field of Classification Search

CPC ..... A47L 9/2868; A47L 5/28; A47L 9/2878; A47L 9/2889; A47L 9/2842; A47L 9/2884

IPC ..... A47L 9/28

See application file for complete search history.

(56) References Cited

U.S. PATENT DOCUMENTS

| | | | |
|---|---|---|---|
| 3,708,962 | A | 1/1973 | Deguchi et al. |
| 4,733,431 | A | 3/1988 | Martin |
| 5,309,600 | A | 5/1994 | Weaver et al. |

(Continued)

FOREIGN PATENT DOCUMENTS

| | | |
|---|---|---|
| CN | 102113861 | 7/2011 |
| EP | 2191762 | 6/2010 |
| TW | M292359 | 6/2006 |

OTHER PUBLICATIONS

International Search Report and Written Opinion for Application No. PCT/US2014/066874 dated Apr. 1, 2015 (17 pages).

*Primary Examiner* — David Redding

(74) *Attorney, Agent, or Firm* — Michael Best & Friedrich LLP

(57) ABSTRACT

A vacuum cleaner including a base including a suction nozzle, a handle assembly pivotally coupled to the base, and a dirt collection assembly removably coupled to at least one of the handle assembly or the base. The dirt collection assembly includes a suction motor operable to generate an airflow through the suction nozzle when powered by a power source, and a dirt separator in fluid communication with the suction nozzle operable to separate and collect dirt particles from the airflow drawn through the suction nozzle by the suction motor. The suction motor is unpowerable when the dirt collection assembly is removed from the at least one of the handle assembly or the base.

16 Claims, 8 Drawing Sheets

(56) References Cited

U.S. PATENT DOCUMENTS

| | | | |
|---|---|---|---|
| 5,524,321 | A | 6/1996 | Weaver et al. |
| 5,715,566 | A | 2/1998 | Weaver et al. |
| 6,532,621 | B2 | 3/2003 | Stephens et al. |
| 7,188,388 | B2 | 3/2007 | Best et al. |
| 7,222,392 | B2 | 5/2007 | McCormick et al. |
| 7,377,007 | B2 | 5/2008 | Best |
| 7,377,008 | B2 | 5/2008 | Park et al. |
| 8,549,703 | B2 | 10/2013 | Smith |
| 8,595,895 | B2 | 12/2013 | Smith |
| 8,657,904 | B2 | 2/2014 | Smith |
| 8,657,905 | B2 | 2/2014 | Smith |
| 2006/0213024 | A1 | 9/2006 | Lee et al. |
| 2007/0113372 | A1 | 5/2007 | McCormick et al. |
| 2009/0307865 | A1 | 12/2009 | Williamson et al. |
| 2012/0222249 | A1 | 9/2012 | Conrad |
| 2013/0091656 | A1 | 4/2013 | Smith |
| 2013/0091658 | A1 | 4/2013 | Smith |
| 2013/0091661 | A1 | 4/2013 | Smith |
| 2013/0091662 | A1 | 4/2013 | Smith |
| 2013/0091810 | A1 | 4/2013 | Smith |
| 2013/0091812 | A1 | 4/2013 | Smith |
| 2013/0091813 | A1 | 4/2013 | Smith |
| 2013/0091814 | A1 | 4/2013 | Smith |
| 2013/0091815 | A1 | 4/2013 | Smith |

VACUUM CLEANER INCLUDING A REMOVABLE DIRT COLLECTION ASSEMBLY

RELATED APPLICATIONS

This application claims priority to U.S. Provisional Patent Application No. 61/907,881, filed Nov. 22, 2013, the entire contents of which are hereby incorporated by reference herein.

BACKGROUND

The present disclosure relates to vacuum cleaners and, more particularly, to upright vacuum cleaners.

Upright vacuum cleaners are typically used to clean floor surfaces, such as carpeting, by generating suction to draw air and dirt through a suction nozzle. The dirt is separated from the air inside the vacuum cleaner and clean air is discharged from the vacuum cleaner. The dirt is collected inside the vacuum cleaner and can be emptied or removed.

SUMMARY

In one aspect, the disclosure provides a vacuum cleaner including a base including a suction nozzle, a handle assembly pivotally coupled to the base, and a dirt collection assembly removably coupled to at least one of the handle assembly or the base. The dirt collection assembly includes a suction motor operable to generate an airflow through the suction nozzle when powered by a power source, and a dirt separator in fluid communication with the suction nozzle operable to separate and collect dirt particles from the airflow drawn through the suction nozzle by the suction motor. The suction motor is unpowerable when the dirt collection assembly is removed from the at least one of the handle assembly or the base.

In another aspect, the disclosure provides a vacuum cleaner having a support assembly, a suction nozzle, and a dirt collection assembly removably coupled to the support assembly. The dirt collection assembly includes a suction motor operable to generate an airflow through the suction nozzle when powered by a power source, and a dirt separator in fluid communication with the suction nozzle operable to separate and collect dirt particles from the airflow drawn through the suction nozzle by the suction motor. The suction motor is unpowerable when the dirt collection assembly is removed from the support assembly.

In yet another aspect, the disclosure provides a vacuum cleaner including a support assembly including a suction nozzle and a battery, and a first electrical connector disposed on the support assembly. The first electrical connector configured to be electrically coupled to the battery. The vacuum cleaner also includes a dirt collection assembly removably coupled to the support assembly. The dirt collection assembly includes a second electrical connector, and a suction motor electrically coupleable to the battery through the first and second electrical connectors. The suction motor is operable to generate a suction force through the suction nozzle when the first and second electrical connectors are electrically connected. The dirt collection assembly also includes a dirt separator configured to remove and collect dirt particles from an airflow drawn through the suction nozzle by the suction motor. The dirt collection assembly is moveable between a connected position in which the dirt separator is in fluid communication with the suction nozzle for collecting the dirt particles and suction motor is electrically connected to the battery through the first and second electrical connectors, and a disconnected position in which the dirt collection assembly is separated from the support assembly and in which the suction motor is electrically disconnected from the battery.

Other aspects of the disclosure will become apparent by consideration of the detailed description and accompanying drawings.

DETAILED DESCRIPTION

Before any constructions of the disclosure are explained in detail, it is to be understood that the disclosure is not limited in its application to the details of construction and the arrangement of components set forth in the following description or illustrated in the following drawings. The disclosure is capable of other constructions and of being practiced or of being carried out in various ways.

FIGS. 1-4 illustrate a vacuum cleaner 10. The illustrated vacuum cleaner 10 is an upright vacuum cleaner having a support assembly which, in the illustrated construction, includes a handle assembly 12 and a base 14. The base 14 is movable along a surface to be cleaned 16, such as a carpeted or hard-surface floor. The handle assembly 12 extends from the base 14. The handle assembly 12 allows a user to move and manipulate the base 14 along the surface to be cleaned 16. The handle assembly 12 is movably coupled to the base 14 such that the handle assembly 12 is movable relative to the base 14 between an upright storage position (FIG. 1) and an inclined operating position (not shown). In other constructions, the vacuum cleaner 10 may include other types of vacuum cleaners having other configurations of support assemblies, such as stick vacuum cleaners, canister vacuum cleaners, hand-held vacuum cleaners, carpet cleaners, etc.

Figure 1:
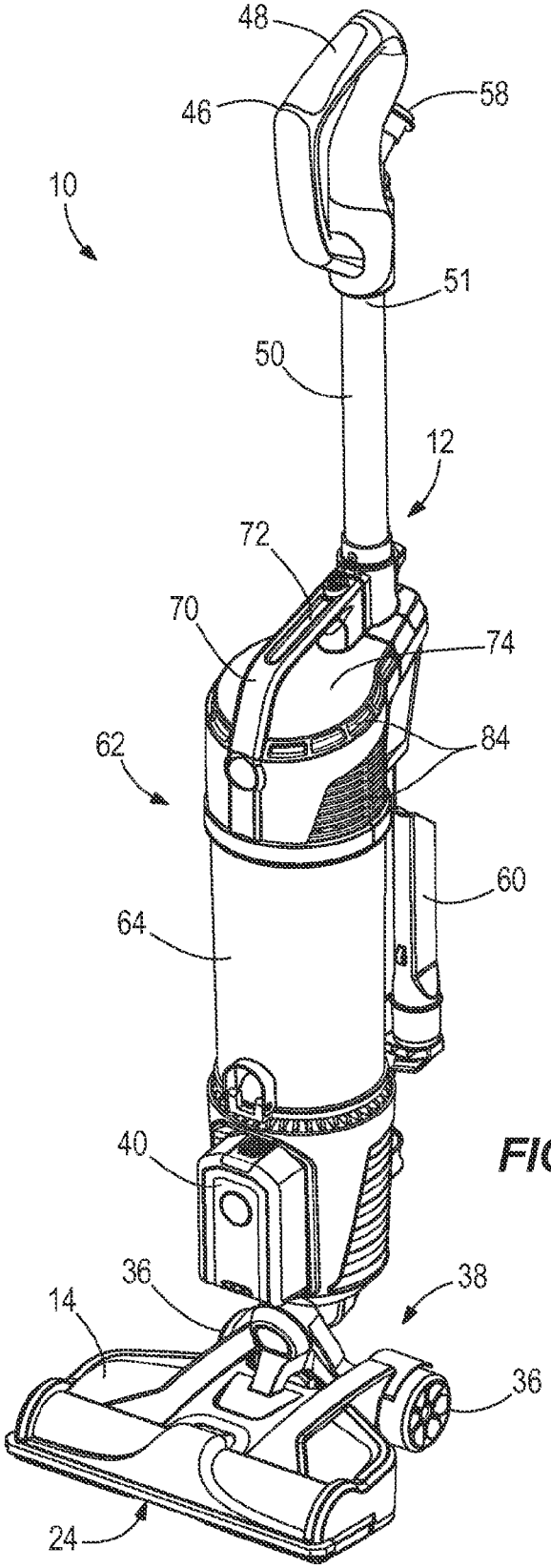
FIG. 1 is a front perspective view of a vacuum cleaner having a support assembly and a dirt collection assembly according to one construction of the disclosure.
Figure 2:
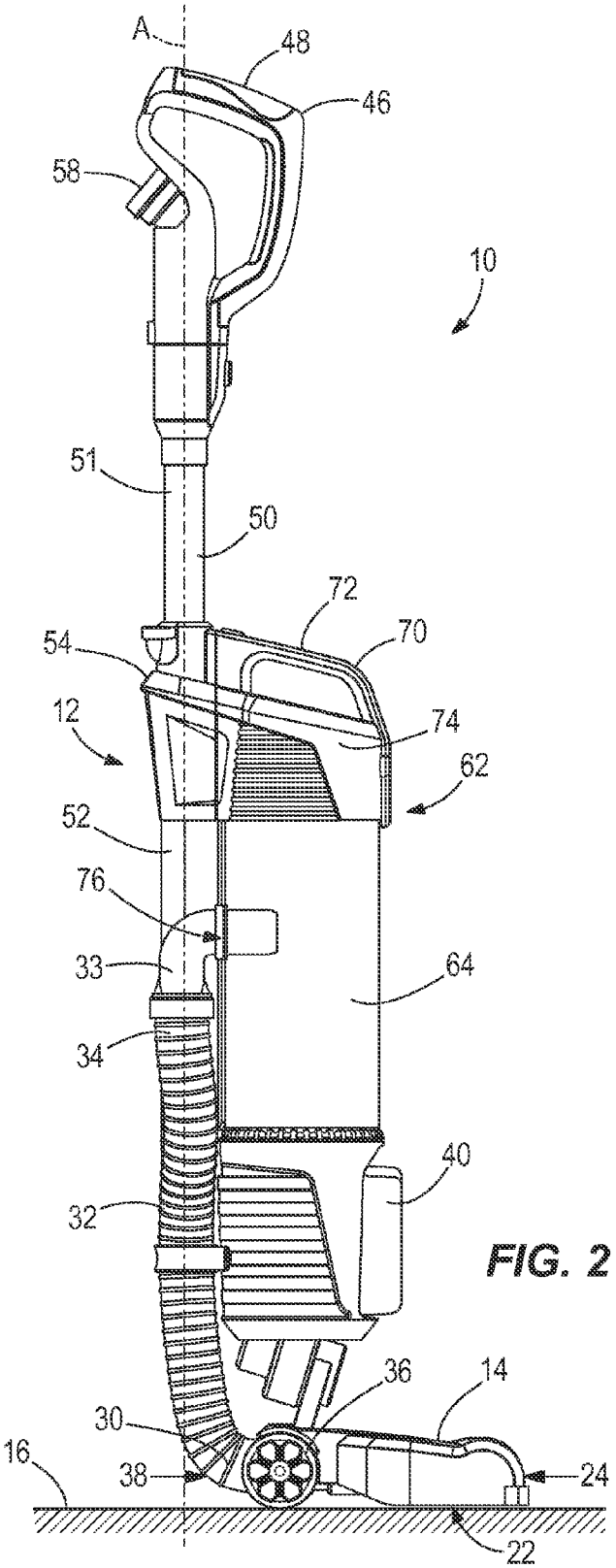
FIG. 2 is a side view of the vacuum cleaner of FIG. 1.
Figure 3:
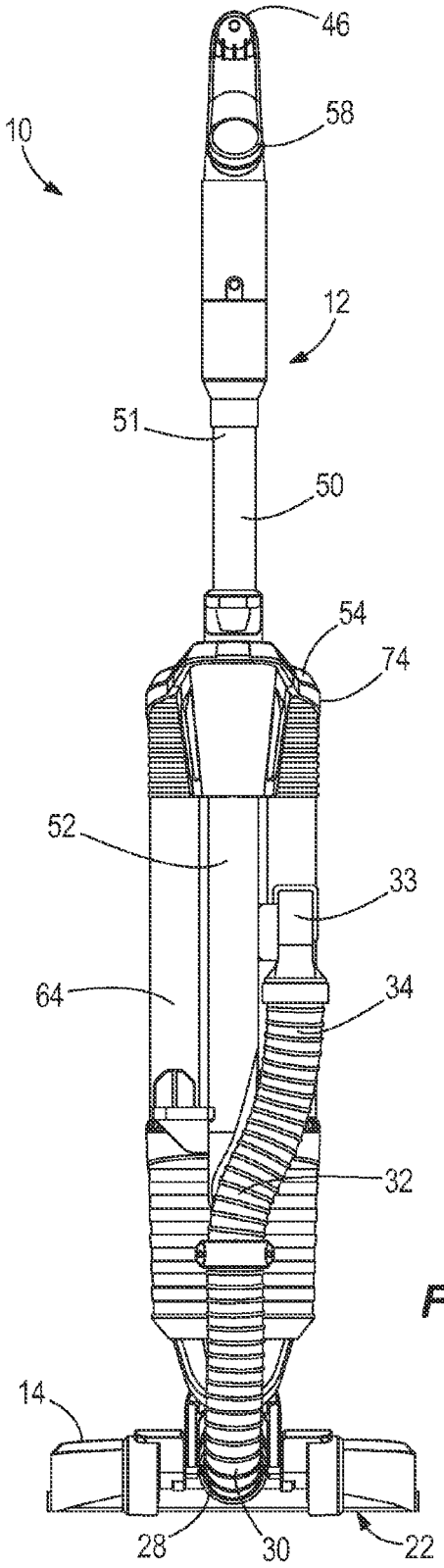
FIG. 3 is a rear view of the vacuum cleaner of FIG. 1.
Figure 4:
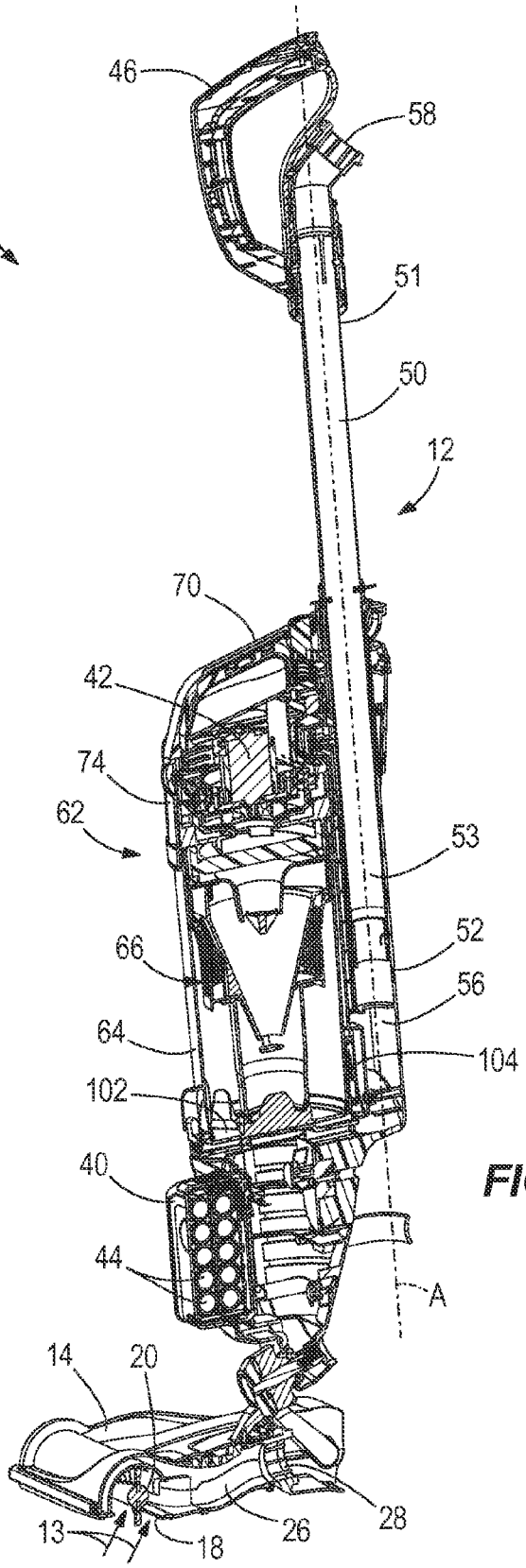
FIG. 4 is a side perspective cross-sectional view of the vacuum cleaner of FIG. 1.

As illustrated in FIG. 4, the base 14 includes a floor nozzle 18 (or suction nozzle) providing an inlet for receiving an airflow 13 into the vacuum cleaner 10 and a brushroll 20 disposed proximate the floor nozzle 18 for agitating dirt on the surface to be cleaned 16. The brushroll 20 is powered for rotation by a brushroll motor (not shown) (e.g., powered by a power source discussed below). In other constructions, the brushroll 20 could be powered by a turbine disposed in the airflow passageway powered by the flow of air or by a suction motor. Power to the brushroll motor can be selectively controlled by an "on/off" switch disposed on the handle assembly or elsewhere on the vacuum cleaner. The illustrated floor nozzle 18 includes an opening formed in a bottom surface 22 of the base 14 adjacent a forward end 24 of the base 14. The base 14 includes an airflow passageway 26 and a first hose connector 28 disposed at a distal end of the airflow passageway 26. The airflow passageway 26 extends from the floor nozzle 18 to the first hose connector 28. A first end 30 of a hose 32 (e.g., a flexible hose) is mechanically coupled to the first hose connector 28 and is thus fluidly coupled to the airflow passageway 26 (FIGS. 2 and 3). A second end 34 of the hose 32 is coupled to an anchor 33 on the handle assembly 12.

A pair of wheels 36 are coupled to the base 14 adjacent a rearward end 38 of the base 14. The wheels 36 facilitate moving the base 14 along the surface to be cleaned 16. In the illustrated construction, the base 14 includes two wheels positioned on opposing sides of the base. In other constructions, the base 14 may include fewer or more wheels. The wheels 36 may be idle wheels or driven wheels.

The handle assembly 12 includes a power source 40 for powering a motor 42 (e.g., a suction motor). In the illustrated construction, the power source 40 includes a battery pack having battery cells 44. In other constructions, other power sources may be used, such as a fuel cell, or a cord and a plug for plugging into a source of utility power, etc. The handle assembly 12 also includes a maneuvering handle 46 having a grip 50 for a user to grasp and maneuver the vacuum cleaner 10, a wand 50, and a spine 52 extending from the base 14 towards the maneuvering handle 46. The handle assembly 12 includes a switch 54 for activating the motor 42. In other constructions, the switch 54 may be disposed proximate the power source 40, proximate the maneuvering handle 46, or elsewhere on the handle assembly 12.

The spine 52 includes an elongated tubular receptacle 56 for receiving the wand 50, the receptacle 56 defining a longitudinal axis A. The wand 50 is coupled to the maneuvering handle 46, and the maneuvering handle 46 and wand 50 are removable from the receptacle 56 together as a unit. A second hose connector 58 is disposed at a first distal end 51 of the wand 50 proximate the maneuvering handle 46 for receiving the hose 32 to fluidly connect the wand 50 to a suction force generated by the motor 42. The wand 50 may be used to clean above-floor surfaces, e.g., stairs, drapes, corners, furniture, etc. An accessory tool 60 (e.g., a crevice tool, an upholstery tool, a pet tool, etc.) is detachably coupled to the handle assembly 12 for storage and may be coupled to a second distal end 53 of the wand 50 for specialized cleaning of non-floor surfaces.

The vacuum cleaner 10 includes a dirt collection assembly 62 supported by the support assembly, e.g., the handle assembly 12 in the illustrated construction. The dirt collection assembly 62 includes a dirt cup 64, a dirt separator 66, the motor 42, a motor housing 74, a diffuser 68, and a dirt collection handle 70 defining a hand grip 72. The motor 42 is disposed generally on top of the dirt cup 64 and dirt separator 66, e.g., in a direction defined generally from the base 14 towards the maneuvering handle 46 generally parallel to the longitudinal axis A when the dirt collection assembly 62 is supported by the handle assembly 12. The motor 42 is substantially enclosed by the motor housing 74. The motor 42 is disposed substantially between the dirt separator 66 (or dirt cup 64) and the dirt collection handle 70 (or hand grip 72). In the illustrated construction, the dirt collection handle 70 is disposed on the motor housing 74. In other constructions, the dirt collection handle 70 may be disposed elsewhere on the dirt collection assembly 62, such as on the dirt cup 64.

The motor 42 drives an impeller 116 and generates a vacuum or suction force in the vacuum cleaner 10. The suction force draws air and dirt into the vacuum cleaner 10 through the floor nozzle 18, through the airflow passageway 26, through the hose 32, through the anchor 33, and into the dirt collection assembly 62 by way of an inlet 76 in the dirt collection assembly 76. The inlet 76 is mechanically coupled to the anchor 33, thereby fluidly coupling the dirt collection assembly 62 to the second end 34 of the hose 32. Thus, the dirt collection assembly 62 is fluidly coupled to the hose 32 and to the airflow passageway 26 in the base 14. If the first end 30 of the hose 32 is connected to the second hose connector 58 in the wand 50, then the suction force draws air and dirt into the vacuum cleaner 10 through the wand 50, through the hose 32, and into the dirt collection assembly 62.

Figure 7:
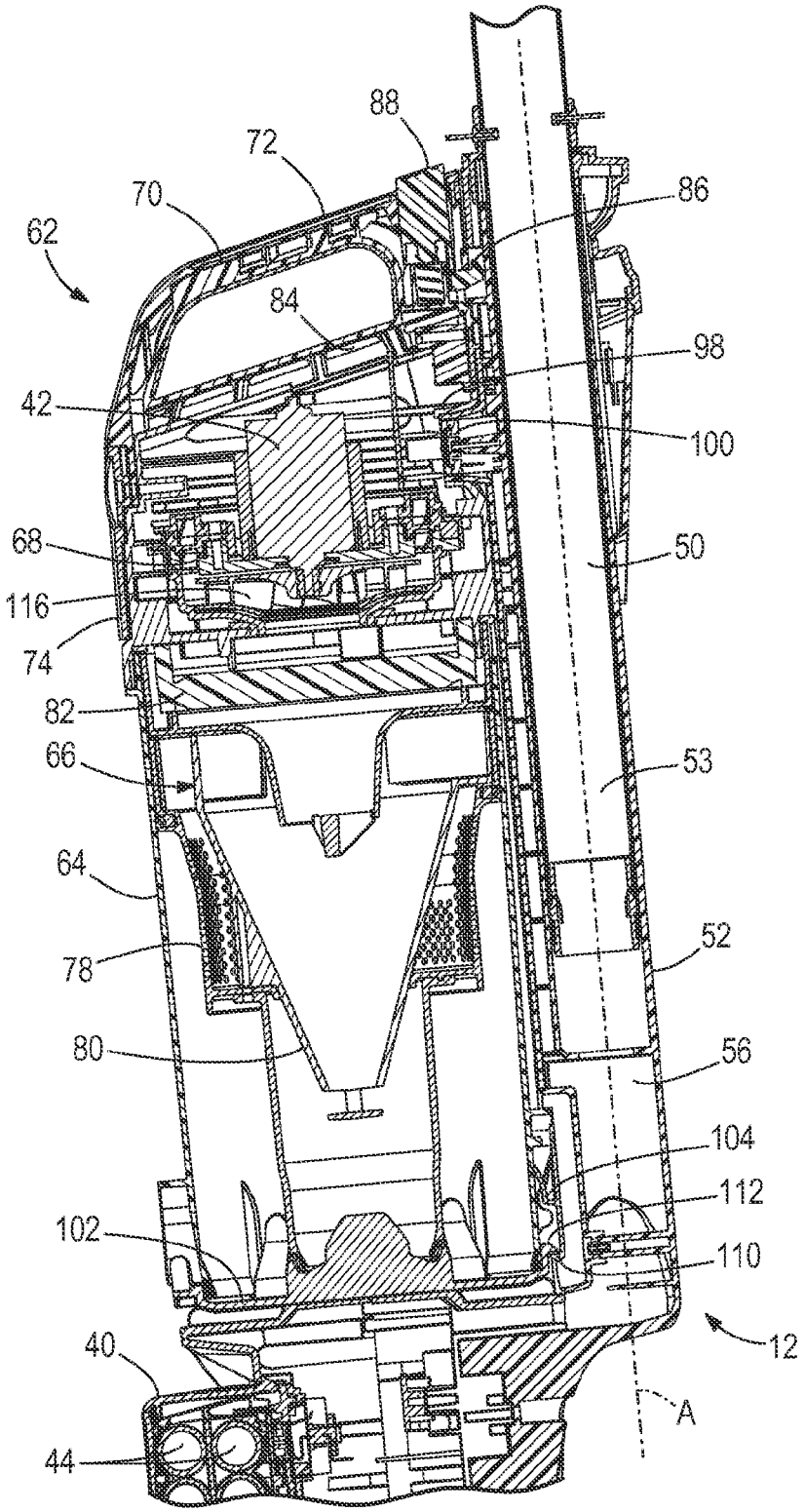
FIG. 7 is a partial cross-sectional view of the vacuum cleaner of FIG. 1.

The dirt separator 66 removes dirt from the airflow 13 drawn into the vacuum cleaner 10 by the suction force, and the dirt cup 64 collects the dirt separated by the dirt separator 66. In the illustrated construction, the dirt separator 66 includes a cyclonic separator, which is best illustrated in FIG. 7. The cyclonic separator includes a first cyclone 78 and a second cyclone 80 arranged substantially concentrically with the first cyclone 78. In the illustrated construction, the dirt separator 66 also includes a filter 82 (FIG. 7) disposed downstream of the dirt separator 66 for trapping additional dirt. In other constructions, the dirt separator 66 may include other types of dirt separators, such as fabric filters, filter bags, static filters, electrostatic precipitators (ESP), wet scrubbers, other inertial separators, etc. The diffuser 68 is disposed downstream of the impeller 116 and slows down the flow of clean air (air from which at least a portion of the dirt has been separated) and reduces noise before the clean air is discharged from openings 84 in the dirt collection assembly 62, specifically, in the motor housing 74.

The dirt collection assembly 62 is removably coupled to the handle assembly 12 such that the dirt collection assembly 62 is moveable between a connected position (FIGS. 1-4) in which the dirt separator 66 is in fluid communication with the floor nozzle 18 for collecting the dirt particles and a disconnected position (FIGS. 5-6) for emptying the dirt particles from the dirt separator 66 in which the dirt separator 66 is not in fluid communication with the floor nozzle 18. The dirt collection assembly 62 includes a latch 86 for removably coupling the dirt collection assembly 62 to the handle assembly 12. The latch 86 is coupled to, and actuatable by, an actuator 88. In the illustrated construction, the actuator 88 is disposed proximate the dirt collection handle 70, preferably on or near the hand grip 72. In other constructions, the actuator 88 may be located on the handle assembly 12 (e.g., on or near the spine 52), on the base 14, or elsewhere on the vacuum cleaner 10. In the illustrated construction, the actuator 88 includes a button depressible to move the latch 86 from an engaged position in which the dirt collection assembly 62 is coupled to the handle assembly 12 (i.e., the connected position) to a released position in which the dirt collection assembly 62 is de-coupled (and may be removed) from the handle assembly 12 (i.e., the disconnected position). The handle assembly includes a latch receptacle 90 (FIGS. 5 and 8) for receiving the latch 86 and a catch 92 for engaging the latch 86 to secure the dirt collection assembly 62 to the handle assembly 12. The actuator 88 is biased to the engaged position by a biasing member 94 (FIG. 8), such as a coil spring. In other constructions, the actuator 88 may include other types of buttons actuatable in different ways, levers, rotatable knobs, magnets, etc., and may include other types of biasing members such as leaf springs, cup springs, elastic members, magnets, etc. In yet other constructions, the dirt collection assembly 62 may be removably coupled to the base 14, or to another portion of the vacuum cleaner 10.

The dirt collection assembly 62 includes a first electrical connector 96 (FIG. 6) electrically coupled to the motor 42.

Figure 5:
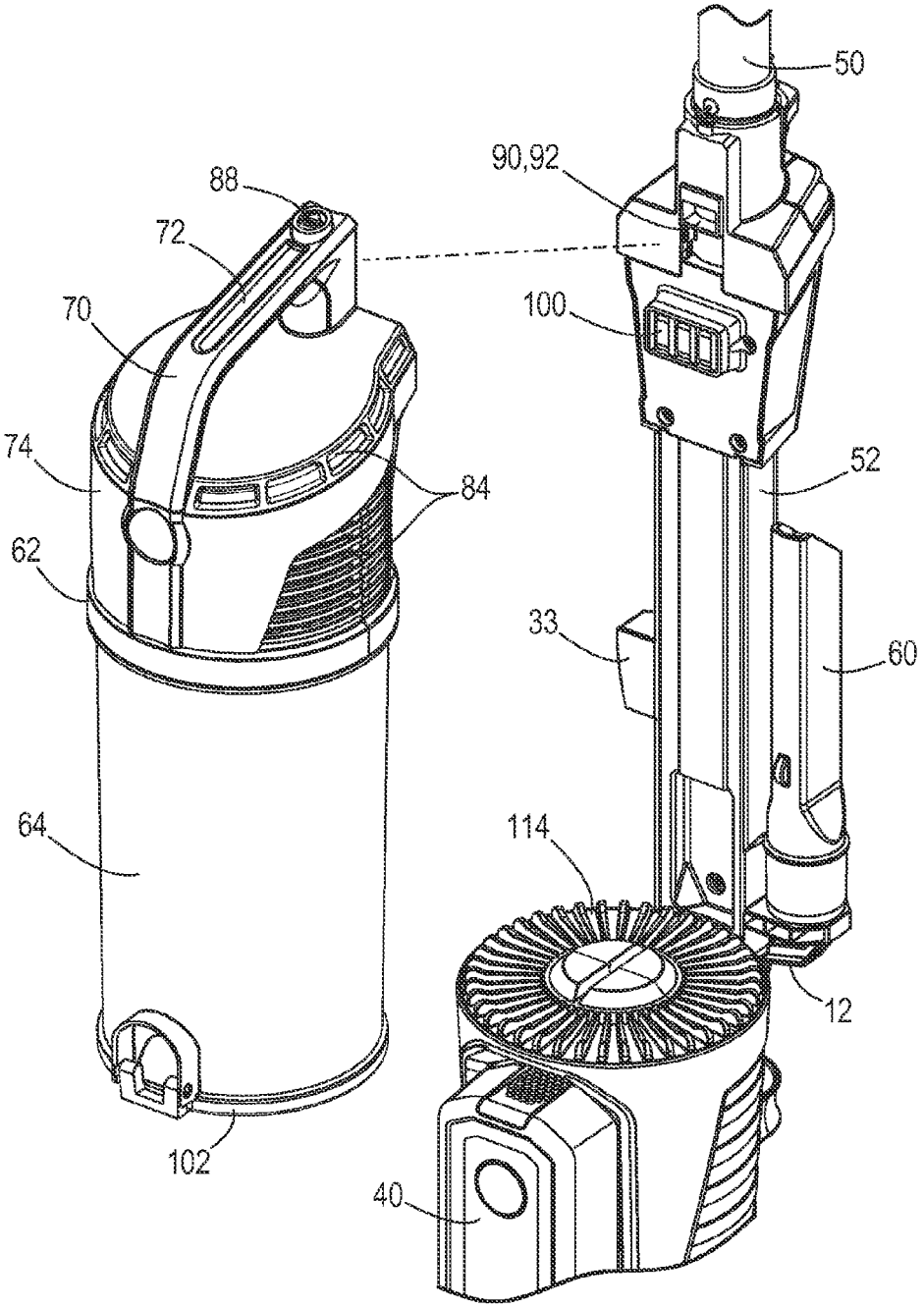
FIG. 5 is a partial front perspective view of the vacuum cleaner of FIG. 1 having the dirt collection assembly removed from the support assembly.
Figure 8:
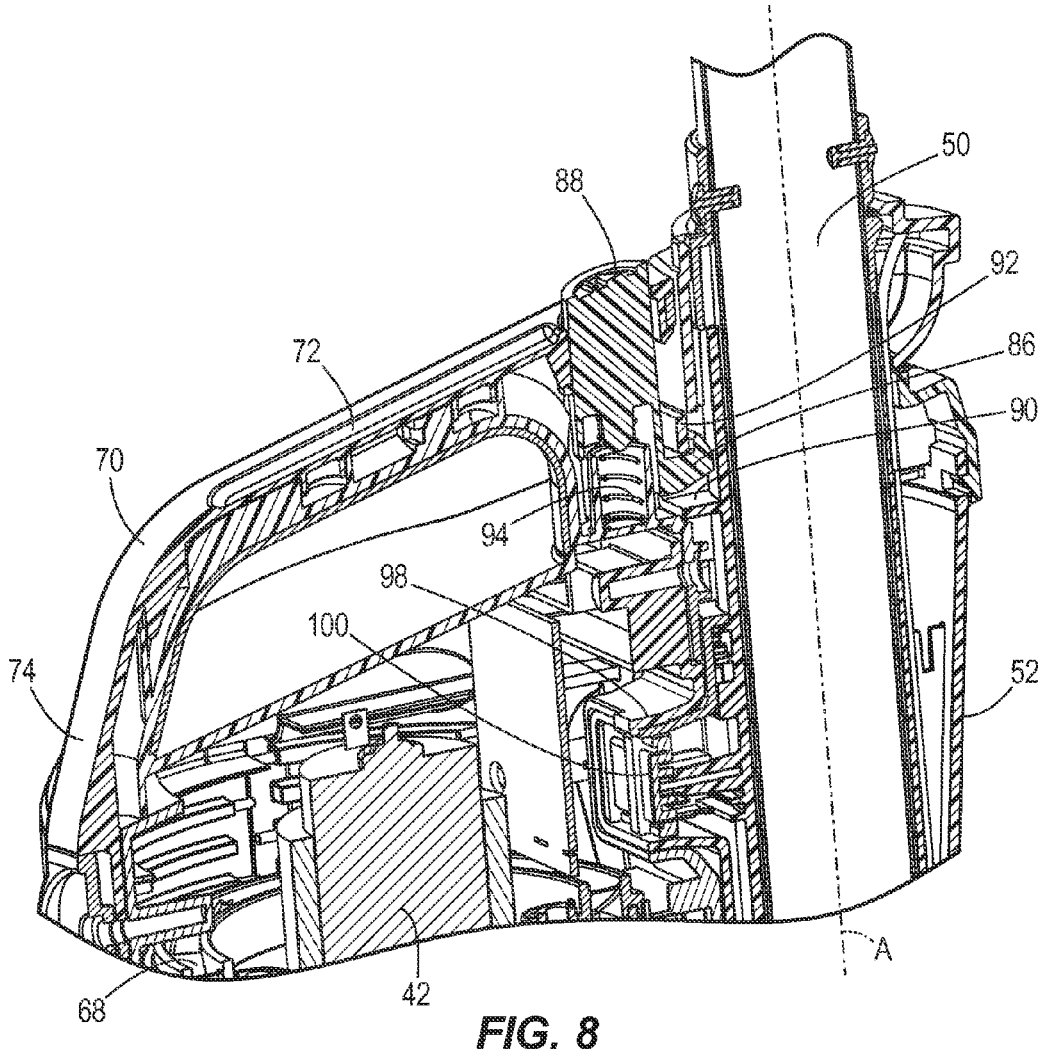
FIG. 8 is an enlarged partial cross-sectional view of the vacuum cleaner of FIG. 1.

The first electrical connector 96 is disposed in a connector receptacle 98 on the dirt collection assembly 62 (more specifically, on the motor housing 74) that receives a corresponding second electrical connector 100 disposed on the handle assembly 12 (more specifically, on the spine 52) (FIGS. 5 and 8). The second electrical connector 100 is electrically coupled to the power source 40 for providing power to the motor 42 when the first and second connectors 96, 100 are coupled. The second electrical connector 100 protrudes from the handle assembly 12 and is shaped and configured to mate with the connector receptacle 98 such that the first electrical connector 96 electrically couples to the second electrical connector 100 when mated (e.g., in the connected position), thereby electrically coupling the power source 40 to the motor 42. When the first and second electrical connectors 96, 100 are not coupled (e.g., in the disconnected position when the dirt collection assembly 62 is removed from the vacuum cleaner 10), the motor 42 is electrically disconnected to the power source 40 and the switch 54 and is unpowerable as the dirt collection assembly 62 does not contain its own independent power source. Thus, the motor 42 cannot be powered unless the dirt collection assembly 62 is in the connected position. In other constructions, the switch 54 may be disposed on the dirt collection assembly 62 and the power source 40 disposed on the handle assembly 12 such that the motor 42 is electrically connected to the switch 54 but not the power source 40 in the disconnected position. The second electrical connector 100 protrudes from the spine 52. In other constructions, the first electrical connector 96 may protrude from the dirt collection assembly 62 and the handle assembly 12 may include the corresponding connector receptacle 98. In yet other constructions, other configurations are possible. For example, the latch 86 and the electrical connectors 96, 100 may be integrated.

Figure 6:
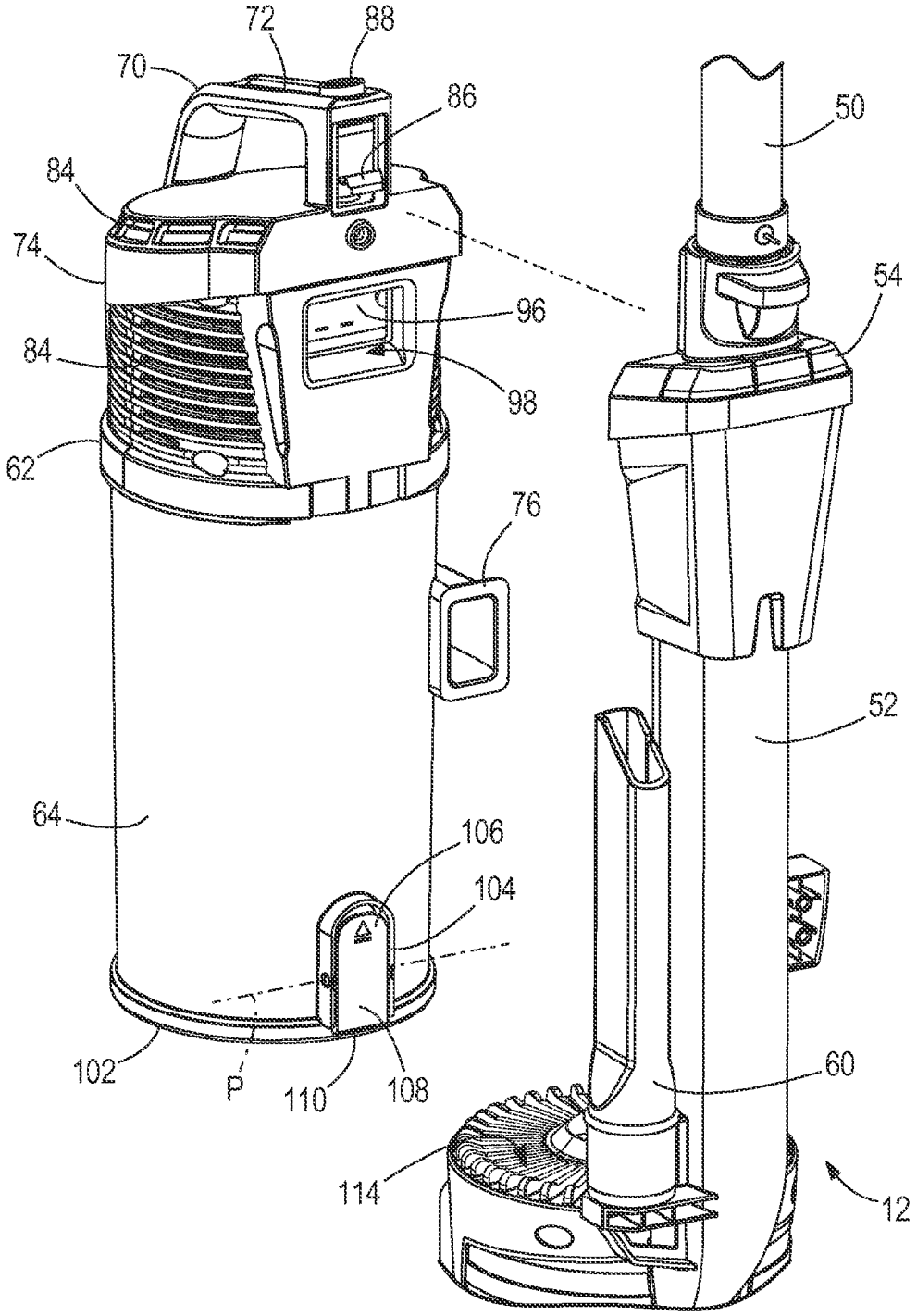
FIG. 6 is a partial rear perspective view of the vacuum cleaner of FIG. 1 having the dirt collection assembly removed from the support assembly.

The dirt collection assembly 62 includes a door 102 and a dirt latch 104 for opening the door 102 (FIG. 6). The door 102 is disposed on the bottom of the dirt cup 64 (e.g., in a direction extending generally from the maneuvering handle 46 towards the base 14 substantially parallel to the longitudinal axis A) generally opposite the motor 42 and the dirt collection handle 70. The door 102 is pivotably coupled to the dirt cup 64 and moveable between a closed position (FIG. 6) in which the dirt is collected in the dirt cup 64 and an open position (not shown) in which the dirt is released from the dirt cup 64. The dirt latch 104 is disposed proximate the handle assembly 12 when the dirt collection assembly 62 is in the connected position (FIG. 7). In the illustrated construction, the dirt latch 104 includes a lever pivotable about a pivot axis P (FIG. 6), the lever 104 including a first portion 106 on one side of the pivot axis P and a second portion 108 on an opposite side of the pivot axis P. The second portion 108 includes a latch portion 110 that engages with a door catch 112 (FIG. 7) to hold the door 102 in the closed position. The first portion 106 is depressible to release the latch portion 110 from the door catch 112 when the dirt cup assembly 62 is in the disconnected position to allow the door 102 to move to the open position. The dirt latch 104 can be actuated when the dirt collection assembly 62 is in the disconnected position. In the connected position, the dirt collection assembly 62 is supported on a support surface 114, which prevents the door 102 from being able to open; and, the dirt latch 104 is inaccessible because it is disposed proximate the spine 52 of the handle assembly 12. In other constructions, other types of dirt latches 104 may be employed, such as other configurations of levers, buttons, magnets, rotatable knobs, etc.

In operation, when the motor 42 is energized, the airflow 13 is drawn by the motor 42 into the vacuum cleaner 10 through the floor nozzle 18 in the base 14. The base 14 directs the airflow 13 into the airflow passageway 26, which directs the airflow 13 into the hose 32 (FIG. 4). The hose 32 directs the airflow 13 into the dirt separator 66 of the dirt collection assembly 62 in the connected position. The airflow 13 then circulates sequentially within the first and second cyclones 78, 80 to remove relatively large dirt and particles from the airflow 13. The airflow 13 also passes through the filter 82 of the dirt collection assembly 62 to remove relatively small dirt and particles from the airflow 13. After passing through the filter 82, the airflow 13 passes through the impeller 116, is directed through the diffuser 68, and toward the motor 42. The cleaned airflow 13 is then exhausted out of the dirt collection assembly 62 through the openings 84 formed in the motor housing 74.

The dirt collection assembly 62 is manufactured and assembled together as a subassembly of the vacuum cleaner 10 that is removable from the vacuum cleaner 10 (e.g., from the support assembly) as one unit. That is, the motor 42, the motor housing 74, the dirt separator 66, and the dirt cup 64 are removable together as one unit. The user grasps the dirt collection handle 70, actuates the latch 86 to release the dirt collection assembly 62 to the disconnected position, and lifts the dirt collection assembly 62 from the handle assembly 12 (or from the base 14 or other portion of the vacuum cleaner 10 in other constructions). Then, the user actuates the dirt latch 104 to release the door 102 to the open position for emptying dirt from the dirt cup 64. The motor 42 and motor housing 74 may be removed from the dirt cup 64 to facilitate changing or cleaning of the filter 82. When the dirt collection assembly 62 is in the disconnected position, the motor 42 is disconnected from both the power source 40 and the switch 54 and cannot be activated. Therefore, the motor 42 is unpowerable in the disconnected position.

Thus, the disclosure provides, among other things, a vacuum cleaner having a dirt collection assembly that is removable to a disconnected position together with the motor such that the motor cannot be activated in the disconnected position. Various features and advantages of the disclosure are set forth in the following claims.

What is claimed is:

1. A vacuum cleaner comprising:
- a base including a suction nozzle;
- a handle assembly pivotally coupled to the base; and
- a dirt collection assembly removably coupled to at least one of the handle assembly or the base, the dirt collection assembly including
  - a suction motor operable to generate an airflow through the suction nozzle when powered by a power source, and
  - a dirt separator in fluid communication with the suction nozzle operable to separate and collect dirt particles from the airflow drawn through the suction nozzle by the suction motor;
- wherein the suction motor is unpowerable when the dirt collection assembly is removed from the at least one of the handle assembly or the base.

2. The vacuum cleaner of claim 1, wherein the suction motor and the dirt separator are removable together as a unit.

3. The vacuum cleaner of claim 1, wherein the dirt collection assembly includes a handle for removing the dirt collection assembly from the at least one of the handle assembly or the base.

4. The vacuum cleaner of claim 3, wherein the suction motor is disposed generally between the dirt separator and the handle.

5. The vacuum cleaner of claim 1, further comprising a first electrical connector, wherein the dirt collection assembly includes a second electrical connector configured to electrically connect to the first electrical connector to provide power to the motor from the power source.

6. The vacuum cleaner of claim 5, wherein the power source includes a battery disposed on the handle assembly.

7. The vacuum cleaner of claim 1, wherein the suction motor is disposed on top of the dirt separator generally opposite the suction nozzle when the dirt collection assembly is coupled to the at least one of the handle assembly or the base.

8. The vacuum cleaner of claim 7, wherein the dirt collection assembly defines a longitudinal axis, wherein the suction motor includes an output shaft oriented substantially parallel to the longitudinal axis.

9. The vacuum cleaner of claim 7, wherein the dirt collection assembly includes a door for releasing dirt from the dirt separator, the door being positioned at the bottom of the dirt separator generally opposite the suction motor.

10. A vacuum cleaner comprising:

a support assembly;

a suction nozzle; and a dirt collection assembly removably coupled to the support assembly, the dirt collection assembly including a suction motor operable to generate an airflow through the suction nozzle when powered by a power source, and a dirt separator in fluid communication with the suction nozzle operable to separate and collect dirt particles from the airflow drawn through the suction nozzle by the suction motor, wherein the suction motor is unpowerable when the dirt collection assembly is removed from the support assembly.

11. The vacuum cleaner of claim 10, wherein the support assembly includes a handle assembly and a base.

12. The vacuum cleaner of claim 10, wherein the support assembly includes the body of a canister vacuum.

13. The vacuum cleaner of claim 10, wherein the power source includes a battery coupled to the support assembly, wherein the support assembly includes a first electrical connector electrically coupled to the battery, and wherein the dirt collection assembly includes a second electrical connector electrically coupled to the first electrical connector when the dirt collection assembly is connected to the support assembly establishing an electrical connection between the battery and the suction motor.

14. The vacuum cleaner of claim 13, wherein the second electrical connector is electrically decoupled from the first electrical connector when the dirt collection assembly is removed from the support assembly making the suction motor unpowerable.

15. The vacuum cleaner of claim 10, wherein the dirt collection assembly includes a door for releasing dirt from the dirt separator and a handle for removing the dirt collection assembly from the support assembly, the door being positioned at the bottom of the dirt separator generally opposite the handle.

16. The vacuum cleaner of claim 10, wherein the suction motor and the dirt separator are removable from the support assembly together as a unit.

* * * * *